US008875951B2

(12) United States Patent
Houser

(10) Patent No.: US 8,875,951 B2
(45) Date of Patent: Nov. 4, 2014

(54) AEROSOL CAP AND SYSTEM FOR DISPENSING A FLUID FROM A CANISTER

(71) Applicant: Kent A. Houser, Twinsburg, OH (US)

(72) Inventor: Kent A. Houser, Twinsburg, OH (US)

( * ) Notice: Subject to any disclaimer, the term of this patent is extended or adjusted under 35 U.S.C. 154(b) by 0 days.

(21) Appl. No.: 13/624,180

(22) Filed: Sep. 21, 2012

(65) Prior Publication Data

US 2013/0075429 A1 Mar. 28, 2013

Related U.S. Application Data

(60) Provisional application No. 61/537,717, filed on Sep. 22, 2011.

(51) Int. Cl.

| | |
|---|---|
| ***B67B 1/00*** | (2006.01) |
| ***B65D 83/00*** | (2006.01) |
| ***B65D 83/22*** | (2006.01) |
| ***B65D 83/20*** | (2006.01) |

(52) U.S. Cl.

CPC ..... *B65D 83/22* (2013.01); *B65D 83/206* (2013.01)

USPC ..... 222/153.11; 222/153.13; 222/402.11; 222/402.12

(58) Field of Classification Search

USPC ..... 222/153.11, 153.13, 153.14, 402.11, 222/402.12, 402.13

See application file for complete search history.

(56) References Cited

U.S. PATENT DOCUMENTS

| | | | | |
|---|---|---|---|---|
| 3,729,119 | A * | 4/1973 | Sette et al. | 222/153.11 |
| 3,738,537 | A * | 6/1973 | Gach | 222/153.11 |
| 3,844,448 | A * | 10/1974 | Sette | 222/153.12 |
| 5,649,645 | A * | 7/1997 | Demarest et al. | 222/153.07 |
| 6,161,736 | A * | 12/2000 | Kaufman et al. | 222/402.13 |
| 6,695,171 | B2 * | 2/2004 | Walters et al. | 222/153.13 |
| 7,530,470 | B1 * | 5/2009 | Houser | 220/780 |
| 7,757,905 | B2 * | 7/2010 | Strand et al. | 222/402.11 |
| 2009/0223956 | A1 * | 9/2009 | Matsukawa et al. | 220/89.2 |

FOREIGN PATENT DOCUMENTS

WO WO 2007017039 A1 * 2/2007

* cited by examiner

*Primary Examiner* — J. Casimer Jacyna
*Assistant Examiner* — Benjamin R Shaw
(74) *Attorney, Agent, or Firm* — Tarolli, Sundheim, Covell & Tummino, LLP

(57) ABSTRACT

An aerosol cap adapted to mate with a canister includes an outer hollow shell and an inner hollow shell that is partially enclosed by the outer shell and centrally disposed therein. The outer hollow shell includes at least one rib element. The inner and outer shells are physically interconnected together by the at least one rib element. The inner hollow shell includes a base ring member hingedly connected to a pod member. The pod member includes a button support for receiving a button actuator of the canister. The pod member further includes a cam profile for cooperating with the at least one rib element to transition the aerosol cap between an operative position and a non-operative position upon rotating the outer hollow shell relative to the inner hollow shell.

8 Claims, 8 Drawing Sheets

AEROSOL CAP AND SYSTEM FOR DISPENSING A FLUID FROM A CANISTER

RELATED APPLICATION

This application claims the benefit of U.S. Provisional Patent Application Ser. No. 61/537,717, filed Sep. 22, 2011, which is hereby incorporated by reference in its entirety for all purposes.

TECHNICAL FIELD

The present invention relates generally to an apparatus and system for dispensing a fluid from a canister, and more particularly to an aerosol cap configured to prevent undesired fluid dispersal from a canister during non-use.

BACKGROUND OF THE INVENTION

Hand-held aerosol canisters are filled with a fluid to be dispensed through a nozzle by a propellant gas. Frequently, the fluid is dispensed as a finely divided spray, but may alternatively be dispensed as a foam or a relatively thin jet. A typical aerosol canister has a valve mounted at its upper end, to which a delivery mechanism is mounted. The valve often has a short projecting tube (a valve stem) on which the delivery mechanism is mounted, although sometimes the delivery mechanism may project into the canister through an aperture to make contact with the valve. A dip tube usually extends downwardly from the valve into the canister, through which fluid is forced by a propellant when the valve is opened.

Small button actuators with nozzles are known for use with such aerosol canisters. Some button actuators release fluid as a result of downward pressure on the actuator, while others release fluid in response to sideways pressure on the actuator (depending on the type of valve used). The button actuators can be installed by being pushed down onto the valve stem (due to a friction fit of the valve stem in a lower bore of the button actuator).

A separate overcap typically fits onto the aerosol canister to protect the button actuator from accidental operation. The use of a separate cap, however, which has to be removed before the button actuator can be accessed, is inconvenient. To overcome the disadvantages of a separate cap, overcaps have been developed that incorporate actuator features so that they can be left in place on the canister when the aerosol dispenser is in use. Such caps, however, can be accidentally actuated during non-use (e.g., during packaging or shipment) and thereby cause inadvertent discharge of pressurized fluid from the canister.

SUMMARY OF THE INVENTION

In one aspect of the present invention, an aerosol cap adapted to mate with a canister is provided. The aerosol cap comprises an outer hollow shell and an inner hollow shell that is partially enclosed by the outer shell and centrally disposed therein. The outer hollow shell includes at least one rib element. The inner and outer shells are physically interconnected together by the at least one rib element. The inner hollow shell comprises a base ring member hingedly connected to a pod member. The pod member includes a button support for receiving a button actuator of the canister. The pod member further includes a cam profile for cooperating with the at least one rib element to transition the aerosol cap between an operative position and a non-operative position upon rotating the outer hollow shell relative to the inner hollow shell.

In another aspect of the present invention, an aerosol cap adapted to mate with a two-piece canister is provided. The aerosol cap comprises an outer hollow shell and an inner hollow shell that is partially enclosed by the outer shell and centrally disposed therein. The outer hollow shell includes at least one rib element. The inner and outer shells are physically interconnected together by the at least one rib element. The inner hollow shell further includes a cam profile for cooperating with the at least one rib element to transition the aerosol cap between an operative position and a non-operative position upon rotating the outer hollow shell relative to the inner hollow shell.

In another aspect of the present invention, a system for dispensing a fluid is provided. The system comprises a two-piece canister, a discharge valve, a button actuator, and an aerosol cap. The two-piece canister is formed to include an interior region to store the fluid. The discharge valve is coupled to the canister to move relative to the canister to discharge the fluid from the interior region of the canister. The button actuator is adapted to engage the discharge valve to move the discharge valve relative to the canister to discharge the fluid from the interior region of the canister. The aerosol cap is mated with the canister and comprises an outer hollow shell and an inner hollow shell that is partially enclosed by the outer shell and centrally disposed therein. The outer hollow shell includes at least one rib element. The inner and outer hollow shells are physically interconnected together by the at least one rib element. The inner hollow shell further includes a cam profile for cooperating with the at least one rib element to transition the aerosol cap between an operative position and a non-operative position upon rotating the outer hollow shell relative to the inner hollow shell.

BRIEF DESCRIPTION OF THE DRAWINGS

The foregoing and other features of the present invention will become apparent to those skilled in the art to which the present invention relates upon reading the following description with reference to the accompanying drawings, in which:

FIG. 51 is a cross-sectional view taken along Line I-I in FIG. 5H;

DETAILED DESCRIPTION

Figure 1A:
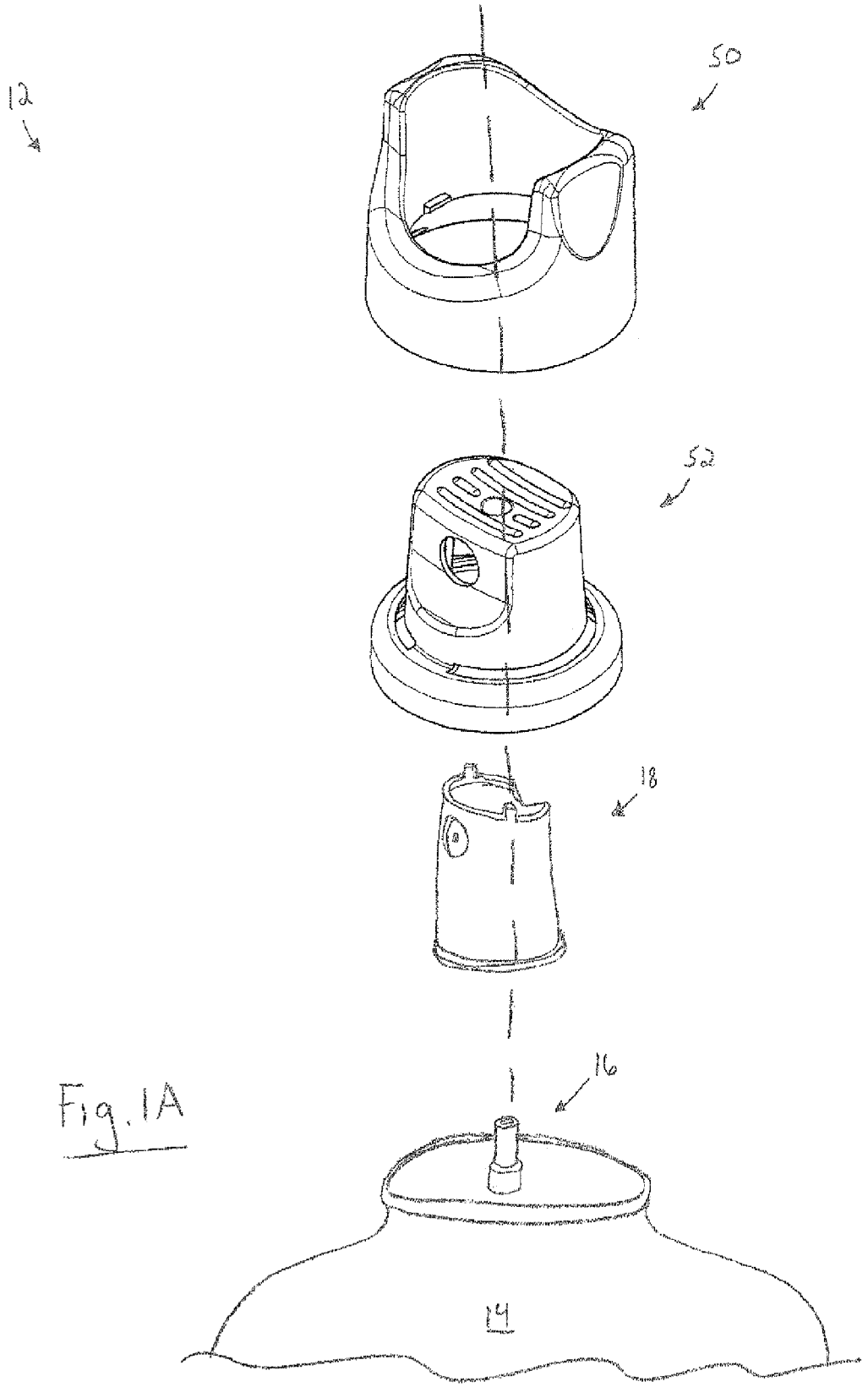
FIG. 1A is an exploded perspective view showing an aerosol cap constructed in accordance with one aspect of the present invention.
Figure 1B:
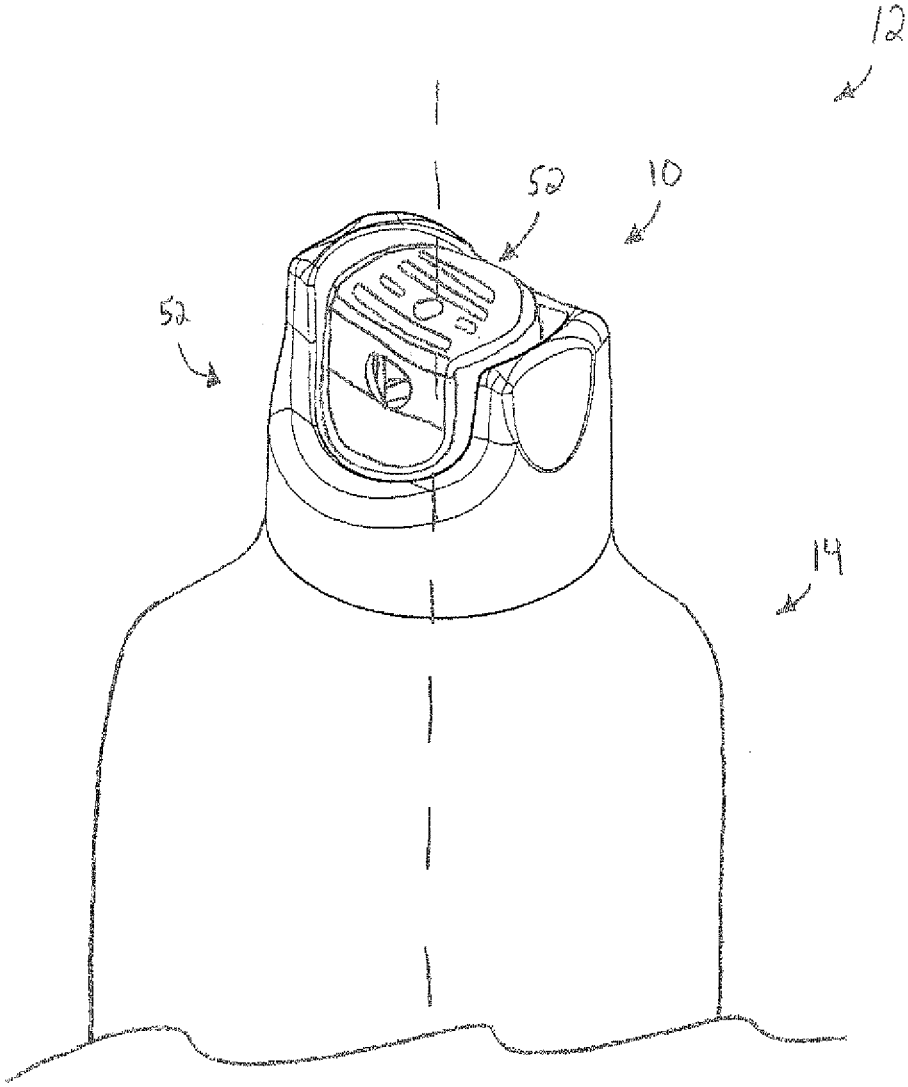
FIG. 1B is a perspective view showing the aerosol cap in FIG. 1A mated with a canister.
Figure 2A:
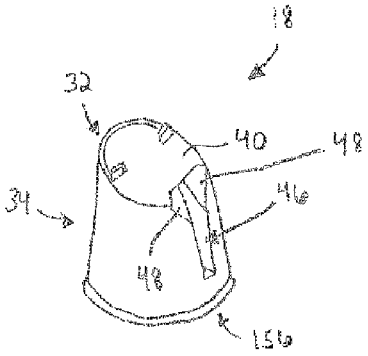
FIG. 2A is a perspective view of the button actuator shown in FIG. 1A.
Figure 2B:
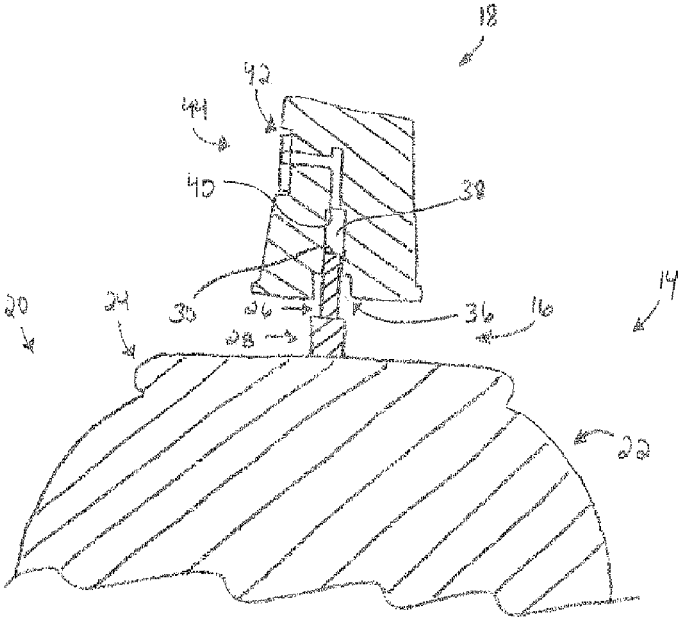
FIG. 2B is a cross-sectional view showing the button actuator in FIG. 2A disconnected from a discharge valve of the canister.
Figure 2C:
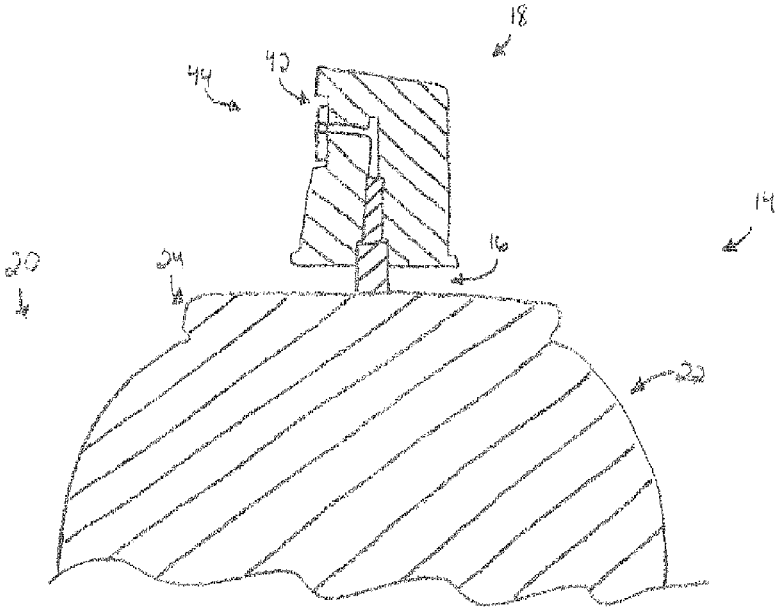
FIG. 2C is a cross-sectional view showing the button actuator in FIG. 2B mated with the discharge valve.

The present invention relates generally to an apparatus and system for dispensing a fluid from a canister, and more particularly to an aerosol cap configured to prevent undesired fluid dispersal from a canister during non-use. As representative of one aspect of the present invention, FIGS. 1A-B illustrate an aerosol cap 10 and system 12 for dispensing a fluid from a canister 14. As described in more detail below, the aerosol cap 10 of the present invention can be easily transitioned between operative and non-operative positions to avoid inadvertent discharge of fluid from a canister during periods of non-use (e.g., during packaging, transport, storage, etc.). Once positioned in the operative or non-operative position, the aerosol cap 10 of the present invention also includes a locking feature that securely maintains the aerosol cap in the desired position. As also described below, the aerosol cap 10 can be readily adapted to mate with newer canister design configurations, such as two-piece canisters. Although the aerosol cap 10 is described herein primarily in terms of dispensing a pressurized fluid, it will be appreciated that the aerosol cap is also capable of dispensing fluid from pump-actuated or pump spray canisters.

As shown in FIGS. 1A-B, one aspect of the present invention includes a system 12 for dispensing a fluid from a canister 14. The system 12 includes a canister 14, a discharge valve 16 coupled to the canister, a button actuator 18 adapted to engage the discharge valve, and an aerosol cap 10 that is capable of mating with the canister. The canister 14 can comprise any conventional aerosol can or dispenser that is formed to include an interior region (not shown) for storing fluid. As is conventional in hand-held aerosol canisters, the canister 14 has a cylindrical body 20 linked to a domed upper portion 22 by a flange or bead 24. Depending upon the construction of the canister 14, the canister can include two or more domed upper portions 22 and two or more flanges or beads 24. Examples of conventional canisters 14 include aluminum-lined canisters, as well as those made from glass, stainless steel, and polyethylene terephthalate.

In one example of the present invention, the canister 14 can include any type of conventional canister that includes a gas propellant and, optionally, a consumer product additive (e.g., furniture polish, insecticide, deodorant, etc.) for dispensing a pressurized fluid therefrom. In another example of the present invention, the canister 14 can comprise a two-piece canister, such as one of the canisters commercially available from DS Containers, Inc. (Batavia, Ill.) and disclosed in U.S. Patent Publication Nos. 2009/0223956 A1 and 2010/00044399 A1, the entireties of which are hereby incorporated by reference. As noted above, it will be appreciated that the canister 14 can alternatively include any type of conventional pump-type dispenser or pump spray canister.

In another aspect of the present invention, the canister 14 includes a discharge valve 16 coupled thereto. Upon actuation, the discharge valve 16 discharges fluid from the interior region of the canister. 14. The discharge valve 16 comprises a valve stem 26 connected to a valve 28 from which a dip tube (not shown) extends to near the base (not shown) of the canister 14. As described in more detail below, the valve stem 26 includes an upper surface 30 for mating with the button actuator 18. Although not shown, it will be appreciated that the dip tube can be inclined or bent so that it terminates near one side of the canister 14. It will also be appreciated that the discharge valve 16 can be push-actuated or tilt-activated.

In another aspect of the present invention, the button actuator 18 is adapted to engage the discharge valve 16 and move the discharge valve relative to the canister 14 so that fluid is discharged from the interior region of the canister. As shown in FIG. 1A and FIGS. 2A-C, the button actuator 18 is formed to include a top wall 32, an outer wall 34 extending down from the top wall, and a valve receiver 36 extending through a portion of the button actuator. The outer wall 34 and the top wall 32 cooperate to define a cavity 38 (FIGS. 2B-C) having an upper surface 40 and formed to receive the valve stem 26 upon movement of the button actuator 18 toward the canister 14. An aperture 42 is formed in the outer wall 34 to align with the nozzle 44 of the button actuator 18.

The button actuator 18 further includes a notch 46 formed in the outer wall 34, and two cam surfaces 48 adjacent the notch. In the proper orientation, the aperture 42 of the button actuator 42 and a side spray aperture 136 (FIG. 5A) of the aerosol cap 10 (FIGS. 1A-B) are aligned to face the same direction, and the upper surface 30 (FIGS. 2A-C) of the valve stem 26 is in flush contact with the upper surface 40 of the cavity 40 so that there is no space therebetween. When the discharge valve 16 is actuated, fluid from the interior region of the canister 14 is moved up through the discharge valve 16 and finally out of the aperture 42 formed in button actuator 18.

In another aspect of the present invention, the aerosol cap 10 comprises an outer hollow shell 50 and an inner hollow shell 52 (FIGS. 1A-B). The outer hollow shell 50 and the inner hollow shell 52 are each molded in a one piece configuration and are generally formed from a plastics material. For example, the outer hollow shell 50 and the inner hollow shell 52 can be formed from a customary flexible organic polymer, such as polypropylene or polyethylene in a conventional injection molding press. It will be appreciated that other additives or resins may also be used to form the aerosol cap 10. For example, clarified resins may be used to impart the aerosol cap with a more transparent or translucent appearance. It will also be appreciated that the aerosol cap 10 can have various finishes, such as a gloss or flat finish.

Figure 3A:
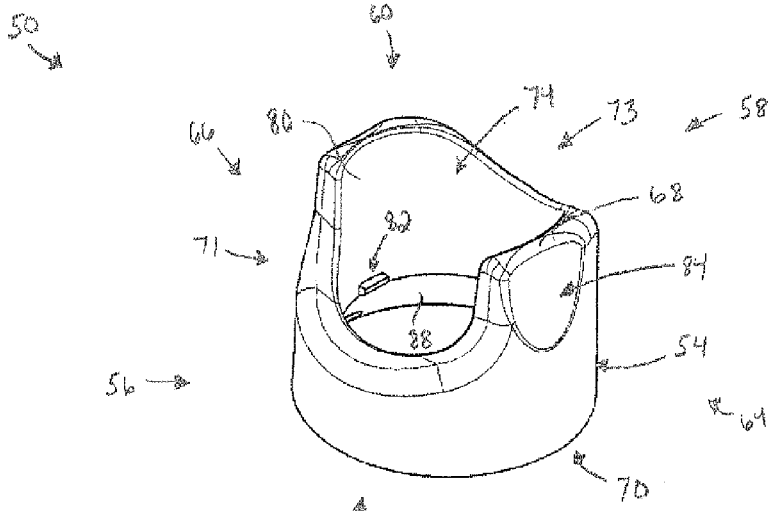
FIG. 3A is a perspective view showing an outer hollow shell of the aerosol cap in FIGS. 1A-B.
Figure 3B:
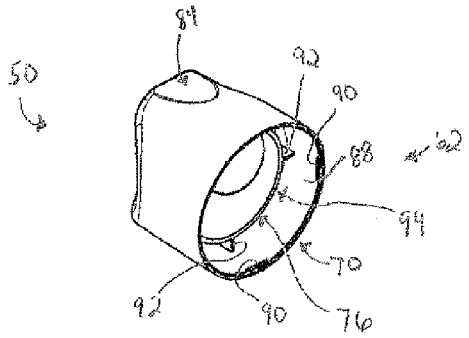
FIG. 3B is an alternative perspective view of the aerosol cap in FIG. 3A.
Figure 3C:
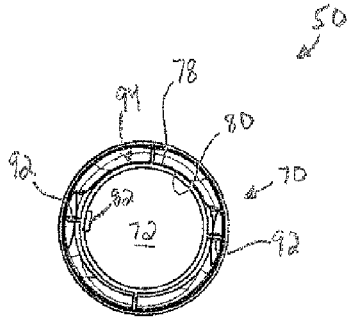
FIG. 3C is a plan view showing the bottom of the outer hollow shell in FIG. 3A.
Figure 3D:
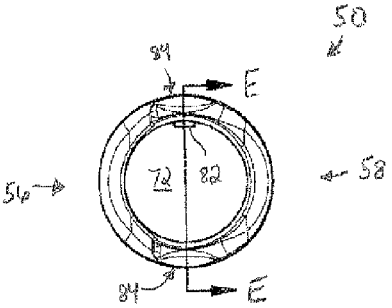
FIG. 3D is a plan view showing the top of the outer hollow shell in FIG. 3A.
Figure 3E:
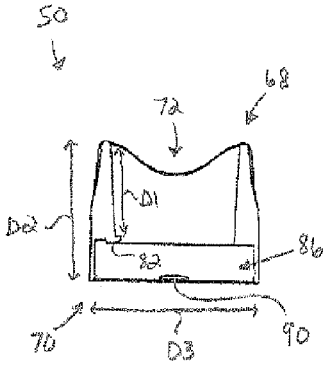
FIG. 3E is a cross-sectional view taken along Line E-E in FIG. 3D.

As shown in FIGS. 3A-E, the outer hollow shell 50 comprises a cylindrical side wall 54 including a front portion 56, a back portion 58, a top portion 60, a bottom portion 62, and oppositely disposed first and second side portions 64 and 66. The cylindrical side wall 54 further includes a top end 68 and a bottom end 70, as well as a spray passage 71 and a finger passage 73 extending therethrough. The outer hollow shell 50 also includes a diameter D3 (FIG. 3E). In one example of the present invention, the diameter D3 can be about 33 mm.

The outer hollow shell 50 includes a central cavity 72, which extends between the top end 68 and the bottom end 70. The central cavity 72 is defined by a cylindrical wall 74 having a bottom end 76, an inner surface 78, an outer surface 80, and the top end 68 of the outer hollow shell 50. The cylindrical wall 74 extends a distance D1 (FIG. 3E) from the top end 68 of the outer hollow shell 50 to the bottom end 76 of the cylindrical wall. The distance Dl is less than a distance D2 that extends between the top end 68 of the outer hollow shell 50 and the bottom end 70 of the cylindrical side wall 54. The cylindrical wall 74 also includes at least one radially-extending rib element 82, which is located adjacent the bottom end 76 of the cylindrical wall.

The cylindrical side wall 54 includes diametrically opposed, inwardly curved finger depressions 84. Each of the finger depressions 84 is disposed between the top and bottom ends 68 and 70 of the cylindrical side wall 54, and extends either partially therebetween. Although each of the finger depressions 84 is shown as having a bullet-shaped configuration, it will be appreciated that the finger depressions can have other shapes (e.g., rectangular, square, circular, ovoid, etc.), and that each of the finger depressions can be differently shaped as compared to one another.

The bottom portion 62 of the outer hollow shell 50 includes a cylindrical receiving portion 86 (FIG. 3E) for mating with a portion of the inner hollow shell 52 (described in more detail below). The receiving portion 86 is defined by an inner surface 88 of the cylindrical side wall 54, the bottom end 70 of the cylindrical side wall, and the bottom end 76 of the cylindrical wall 74. The bottom portion 62 of the outer hollow shell 50 also includes at least one detent 90 that extends radially from the inner surface 88 of the cylindrical side wall 54. The detent(s) 90 can facilitate attachment of the aerosol cap 10 to the canister 14 (e.g., via the flange or bead 24).

As shown in FIGS. 3B-C, the outer hollow shell 50 also includes a plurality of reinforcement ribs 92. Each of the reinforcement ribs 92 extends radially between the inner surface 88 of the cylindrical side wall 54 and the outer surface 80 of the cylindrical wall 74. Each of the reinforcement ribs 92 also extends axially between the top end 68 of the outer hollow shell 50 and the bottom end 76 of the cylindrical wall 74. A cavity 94 is defined between each of the reinforcement ribs 92, the top end 68 of the outer hollow shell 50, and the bottom end 76 of the cylindrical wall 74.

Another embodiment of the outer hollow shell $\mathbf{50}_a$ is shown in FIGS. 4A-E. In FIGS. 4A-E, structures that are identical to those in FIGS. 3A-E use the same reference number, whereas structures similar to those in FIGS. 3A-E carry the suffix "a". Although the aerosol cap 10 of the present invention is illustrated and described as comprising the outer hollow shell 50 shown in FIGS. 3A-E, it will be appreciated that the outer hollow shell $\mathbf{50}_a$ shown in FIGS. 4A-E and described below may be equally used to form the aerosol cap and dispense a fluid therefrom.

Figure 4A:
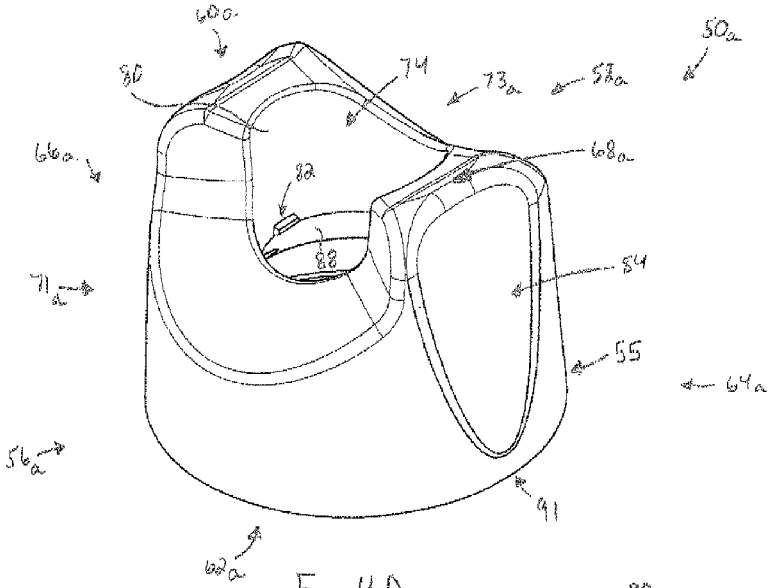
FIG. 4A is a perspective view showing an alternative construction of the outer hollow shell in FIG. 3A.
Figure 4B:
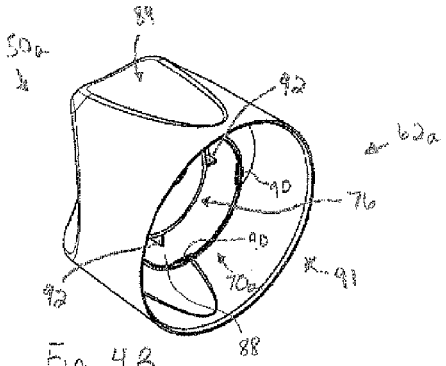
FIG. 4B is an alternative perspective view of the aerosol cap in FIG. 4A.
Figure 4C:
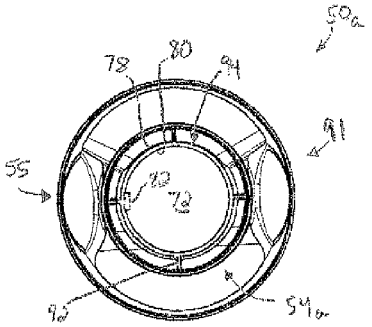
FIG. 4C is a plan view showing the bottom of the outer hollow shell in FIG. 4A.
Figure 4D:
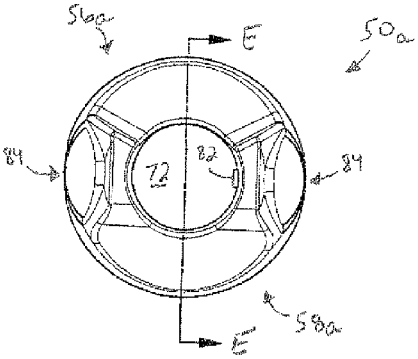
FIG. 4D is a plan view showing the top of the outer hollow shell in FIG. 4A.
Figure 4E:
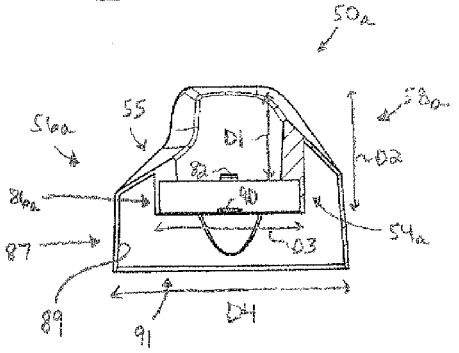
FIG. 4E is a cross-sectional view taken along Line E-E in FIG. 4D.

As shown in FIGS. 4A-E, the outer hollow shell $\mathbf{50}_a$ comprises a first cylindrical side wall $\mathbf{54}_a$ radially spaced apart from a second cylindrical side wall 55. Each of the first and second cylindrical side walls $\mathbf{54}_a$ and 55 include a front portion $\mathbf{56}_a$, a back portion $\mathbf{58}_a$, a top portion $\mathbf{60}_a$, a bottom portion $\mathbf{62}_a$, and oppositely disposed first and second side portions $\mathbf{64}_a$ and $\mathbf{66}_a$. Additionally, each of the first and second cylindrical side walls $\mathbf{54}_a$ and 55 includes a top end $\mathbf{68}_a$. The second cylindrical side wall 55 also includes a spray passage $\mathbf{71}_a$ and a finger passage $\mathbf{73}_a$ extending therethrough. As shown in FIG. 4E, the second cylindrical side wall 55 defines a diameter D4. in one example of the present invention, the diameter D4 can be about 57 mm.

The outer hollow shell 50, includes a central cavity 72, which extends between the top end $\mathbf{68}_a$ and a bottom end $\mathbf{70}_a$ of the first cylindrical side wall $\mathbf{54}_a$. The central cavity 72 is defined by a cylindrical wall 74 having a bottom end 76, an inner surface 78, an outer surface 80, and the top end $\mathbf{68}_a$ of the outer hollow shell $\mathbf{50}_a$. The cylindrical wall 74 extends a distance D1 (FIG. 4E) from the top end $\mathbf{68}_a$ of the outer hollow shell $\mathbf{50}_a$ to the bottom end 76 of the cylindrical wall. The distance D1 is less than a distance D2 that extends between the top end $\mathbf{68}_a$ of the outer hollow shell $\mathbf{50}_a$ and the bottom end 76 of the cylindrical side wall 70. The cylindrical wall 74 also includes at least one radially-extending rib element 82, which is located adjacent the bottom end 76 of the cylindrical wall.

As described above, the second cylindrical side wall 55 includes diametrically opposed, inwardly curved finger depressions 84. For example, each of the finger depressions 84 is disposed between the top end $\mathbf{68}_a$ and a bottom end 91 of the second cylindrical side wall 55, and extends essentially completely therebetween.

The outer hollow shell $\mathbf{50}_a$ includes a first cylindrical receiving portion $\mathbf{86}_a$ (FIG. 4E) for mating with a portion of the inner hollow shell 52. The first receiving portion $\mathbf{86}_a$ is defined by an inner surface 88 of the first cylindrical side wall $\mathbf{54}_a$, the bottom end $\mathbf{70}_a$ of the first cylindrical side wall, and the bottom end 76 of the cylindrical wall 74. The outer hollow shell $\mathbf{50}_a$ also includes a second cylindrical receiving portion 87 for mating with a portion of the canister 14, such as the domed upper portion 22. The second cylindrical receiving portion 87 is defined by an inner surface 89 of the second cylindrical side wall 55, the bottom end 91 of the second cylindrical side wall, and the bottom end 76 of the cylindrical wall 74.

As shown in FIGS. 4B-C, the outer hollow shell $\mathbf{50}_a$ also includes a plurality of reinforcement ribs 92. Each of the reinforcement ribs 92 extends radially between the inner surface 88 of the first cylindrical side wall $\mathbf{54}_a$ and the outer surface 80 of the cylindrical wall 74. Each of the reinforcement ribs 92 also extends axially between the top end $\mathbf{68}_a$ of the outer hollow shell $\mathbf{50}_a$ and the bottom end 76 of the cylindrical wall 74. A cavity 94 is defined between each of the reinforcement ribs 92, the top end $\mathbf{68}_a$ of the outer hollow shell $\mathbf{50}_a$, and the bottom end 76 of the cylindrical wall 74.

Figure 5A:
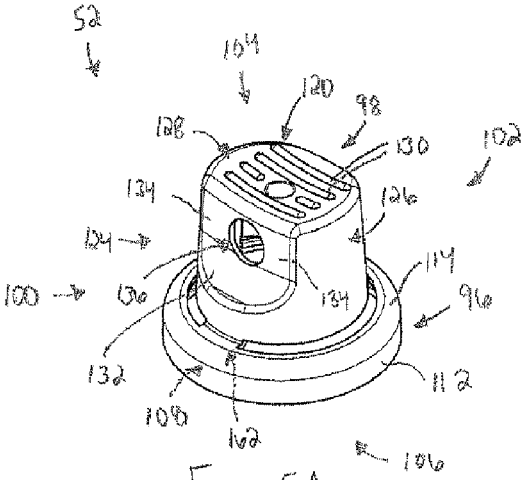
FIG. 5A is a perspective view showing an inner hollow shell of the aerosol cap in FIGS. 1A-B.
Figure 5B:
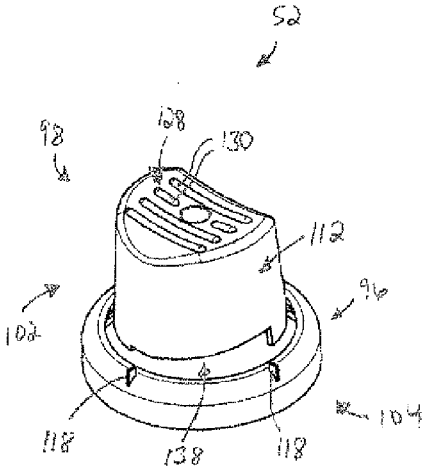
FIG. 5B is an alternative perspective view of the inner hollow shell in FIG. 5A.
Figure 5C:
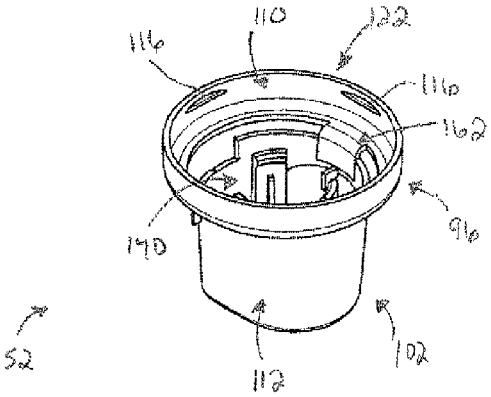
FIG. 5C is another alternative perspective view of the inner hollow shell in FIG. 5A.
Figure 5D:
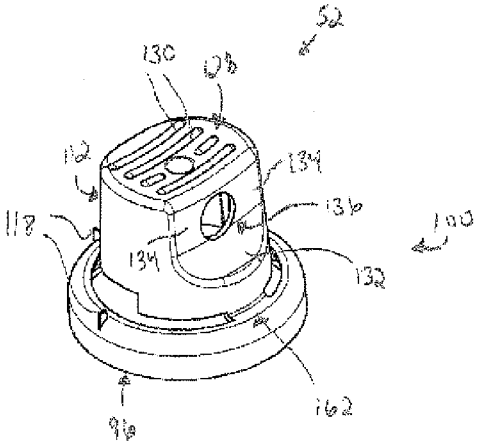
FIG. 5D is another alternative perspective view of the inner hollow shell in FIG. 5A.

The inner hollow shell 52 (FIGS. 5A-I) of the aerosol cap 10 comprises a base ring member 96 hingedly connected to a pod member 98, The inner hollow shell 52 includes oppositely disposed front and back portions 100 and 102, as well as oppositely disposed first and second side portions 104 and 106. The base ring member 96 (FIGS. 5A-B) is defined by an outer surface 108 and an inner surface 110 (FIG. 5C) that collectively define a cylindrical side wall 112 linked to a domed upper portion 114. The inner surface 110 of the base ring member 96 also includes at least one radially-extending detent 116 to facilitate attachment of the aerosol cap 10 to the canister 14 (e.g., via the flange or bead 24). Additionally, the upper portion 114 of the base ring member 96 includes two circumferentially spaced apart stop detents 118 (FIG. 5B). As described in more detail below, the stop detents 118 cooperate with the reinforcement ribs 92 to form part of the locking feature and thereby securely maintain the aerosol cap 10 in the operative and non-operative configurations.

The pod member 98 of the inner hollow shell 52 has a somewhat cylindrical configuration and comprises a closed top end 120, an open bottom end 122, a front wall 124, and a cylindrical side wall 126. The pod member 98 is centrally disposed within the base ring member 96 and has a circumference that is less than the circumference of the base ring member. The top end 120 of the pod member 98 includes a finger panel 128 having a plurality of raised traction members 130. The front wall 124 is defined by an arcuate base portion 132 and oppositely disposed side portions 134 that are linked to the top end 120 and the arcuate base portion 132. A side spray aperture 136 is located between the side portions 134. As shown in FIG. 5A, the side spray aperture 136 has a circular cross-sectional profile. It will be appreciated, however, that the side spray aperture 136 can have any desired cross-sectional profile (e.g., rectangular, square, ovoid, etc.). As shown in FIG. 5B, the first side portion 104 of the pod member 98 includes a cam profile 138 for cooperating with the rib element 82 to transition the aerosol cap 10 between the operative and non-operative positions.

Figure 5E:
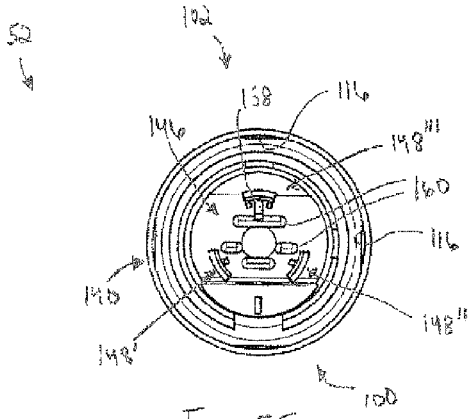
FIG. 5E is a plan view showing the bottom of the inner hollow shell in FIG. 5A.
Figure 5F:
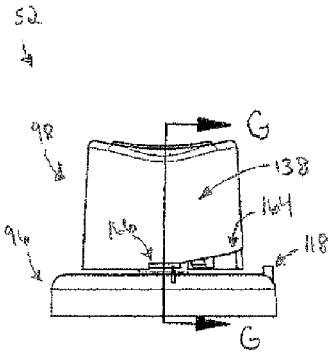
FIG. 5F is a side view of the inner hollow shell in FIG. 5A.
Figure 5G:
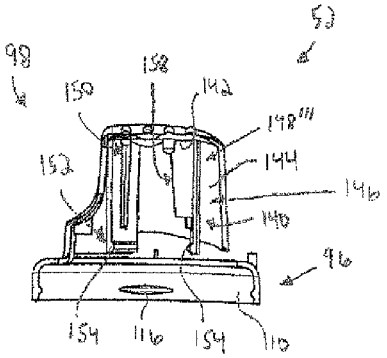
FIG. 5G is a cross-sectional view taken along Line G-G in FIG. 5F.
Figure 5H:
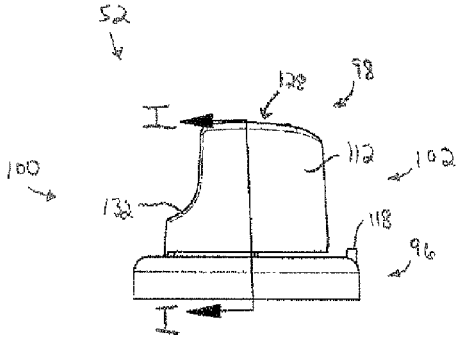
FIG. 5H is another side view of the inner hollow shell in FIG. 5A.
Figure 5I:
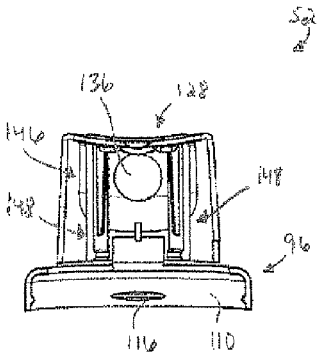

Referring to FIGS. 5E-I, the pod member 98 further includes an interior region 140 defined by an upper interior surface 142 and a cylindrical interior surface 144. The interior region 140 includes a button support 146 for receiving the button actuator 18. The button support 146 comprises a series of radially spaced apart elongated ribs 148, each of which extends axially from the upper interior surface 142 of the pod member 98 towards the base ring member 96. Each of the elongated ribs 148 includes oppositely disposed first and second ends 150 and 152. The first end 150 of each of the elongated ribs 148 is linked to the upper interior surface 142 of the pod member 98, and the second end 152 of each of the elongated ribs is free from attachment to the pod member. The second end 152 of each of the elongated ribs 148 includes a radial projection 154 for engaging a bottom end 156 (FIGS. 2A-C) of the button actuator 18. As shown in FIG. 5E, the button support 146 comprises a first elongated rib 148', a second elongated rib 148", and a third elongated rib 148'. The third elongated rib 148'" includes a fin 158 for coupling and positioning of the button actuator 18 (described in more detail below). The upper interior surface 142 of the pod member 98 further includes a series of raised positioning elements 160 to facilitate coupling and positioning of the button actuator 18 to the button support 146.

The pod member 98 is physically interconnected with the base ring member 96 via a flexible hinge 162 that allows the pod member to pivot relative to the base ring member upon application of an axial force to the finger panel 128. The flexible hinge 162 is circumferentially aligned with the side spray aperture 136. Although only one flexible hinge 162 is shown in FIGS. 5A-I, it will be appreciated that more than one flexible hinge can be included to physically interconnect the base ring member 96 with the pod member 98.

Use of the aerosol cap 10 to dispense fluid from a canister 14 is described below in terms of dispensing a pressurized fluid from a two-piece canister; however, as noted above, it will be appreciated that the present invention should not be understood as being so limited. Operation of the aerosol cap 10 begins by selecting an aerosol cap having a desired size. Depending upon the type and diameter of the canister 14, an aerosol cap 10 having an outer hollow shell 50 with a diameter D3 of about 33 mm or a diameter D4 of about 57 mm can be selected, for example.

If it has not been done so already, the selected aerosol cap 10 is then formed by mating the inner hollow shell 52 with the outer hollow shell 50 so that the inner hollow shell is centrally disposed therein. More particularly, the pod member 98 of the inner hollow shell 52 is placed within the central cavity 72 of the outer hollow shell 50 and progressively advanced therethrough until the base ring member 96 engages the receiving portion 86 of the outer hollow shell. The inner hollow shell 52 is further advanced through the central cavity 72 so that the rib element 82 is snap-fit into engagement with the cam profile 138, thereby securing the inner hollow shell within the outer hollow shell 50.

Following assembly of the inner and outer hollow shells 52 and 50, the button actuator 18 is securely disposed in the button support 146. To do so, the button actuator 18 is first positioned about the button support 146 so that the notch 46 is aligned with the fin 158 of the third elongated rib 148'". An axial force is then applied to the bottom end 156 of the button actuator 18 so that the fin 158 is guided into the notch 46 via the cam surfaces 48. Next, the button actuator 18 is advanced toward the top end 120 of the pod member 98 until the upper surface 40 of the button actuator engages the positioning elements 160 and the aperture 42 of the button actuator is circumferentially aligned with the side spray aperture 136. The button actuator 18 can then be further advanced, if needed, so that the radial projections 154 engage the bottom end 156 of the button actuator and thereby secure the button actuator in the button support 146.

It will be appreciated that assembly of the button actuator 18 with the button support 146 can vary depending upon assembly or manufacturing requirements of the aerosol cap 10. Where the button actuator 18 is first mated with the discharge valve 16 of the canister 14, for example, the aerosol cap 10 can be positioned over the canister so that the fin 158 of the button support 146 is aligned with the notch 46 of the button actuator. Next, an axial force can be applied to the finger panel 128 of the pod member 98 so that the button actuator 18 is received within the button support 146. The axial force can be applied until the upper surface 40 of the button actuator 18 engages the positioning elements 160, and the aperture 42 of the button actuator is circumferentially aligned with the side spray aperture 136. It will be further appreciated that, depending upon assembly and manufacturing requirements of the aerosol cap 10, the button actuator 18 can be disposed in the button support 146 prior to assembly of the inner hollow shell 52 with the outer hollow shell 50.

Figure 6A:
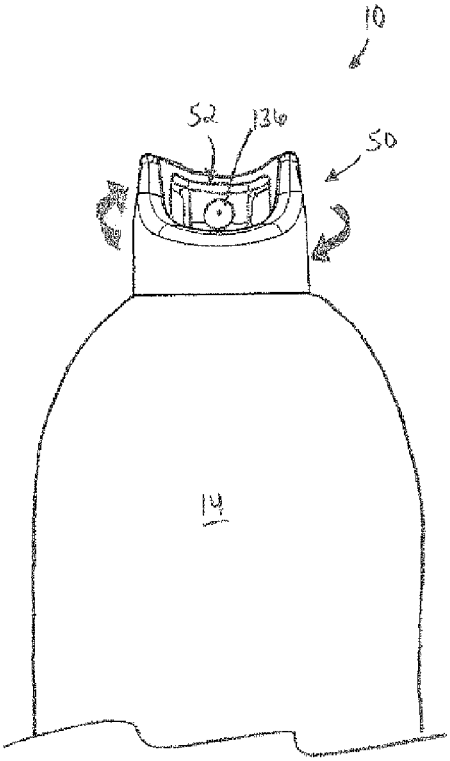
FIG. 6A is a perspective view showing the aerosol cap in FIG. 1B in an operative position.
Figure 6B:
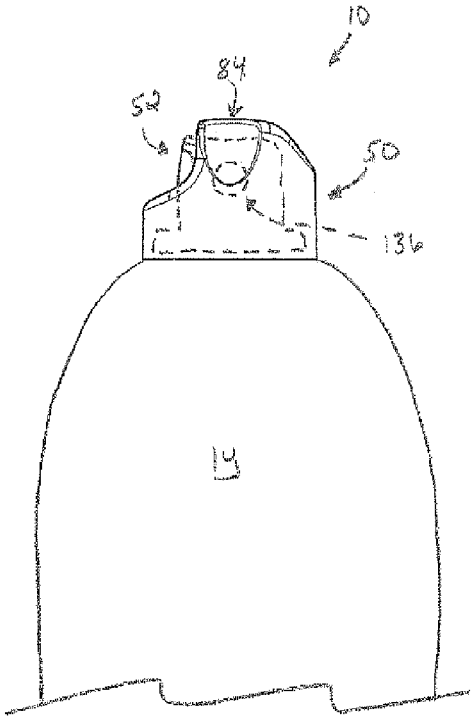
FIG. 6B is a perspective view showing the aerosol cap in FIG. 6A in a non-operative position.

Once the aerosol cap 10 is securely mated with the button actuator 18 and the canister 14, the aerosol cap can be selectively transitioned between the operative position (FIG. 6A) and the non-operative position (FIG. 6B). In the operative position, the rib element 82 engages a first end 164 of the cam profile 138. To transition the aerosol cap 10 into the non-operative position, the outer hollow shell 50 is rotated relative to the inner hollow shell 52 by placing a user's fingers on the finger depressions 84 and rotating the outer hollow shell as shown in FIG. 6A. Rotation of the outer hollow shell 50 causes the rib element 82 to move over and along the cam profile 138, which in turn causes the pod member 98 to be axially displaced in an upward direction (i.e., toward the top portion 60 of the outer hollow shell). Rotation of the outer hollow shell 50 is stopped when the rib element 82 engages a second end 166 of the cam profile 138. In this position (i.e., the non-operative position), the rib element 82 prevents movement of the pod member 98 in a downward direction (i.e., toward the bottom portion 62 of the outer hollow shell 50) and, thus, inadvertent discharge of pressurized fluid from the canister 14.

When release of the pressurized fluid is desired, the outer hollow shell 50 can be rotated in a counter-clockwise direction so that the rib element 82 moves from the second end 166 to the first end 164 of the cam profile 138, Movement of the rib element 82 toward the first end 164 of the cam profile 138 causes the pod member 98 to be axially displaced in a downward direction. In this position, an axial force can be applied to the finger panel 128 of the pod member 98 to actuate the button actuator 18 and thereby dispense the pressurized fluid from the canister 14.

From the above description of the invention, those skilled in the art will perceive improvements, changes and modifications. Such improvements, changes, and modifications are within the skill of the art and are intended to be covered by the appended claims.

Having described the invention, the following is claimed:

1. An aerosol cap comprising:

an outer hollow shell that includes at least one rib element; and an inner hollow shell that is partially enclosed by said outer shell and centrally disposed therein, said inner and outer shells being physically interconnected together by said at least one rib element, said inner hollow shell comprising a base ring member hingedly connected to a pod member, said pod member including a button support for receiving a button actuator of a canister, said pod member further including a cam profile for cooperating with said at least one rib element to transition said aerosol cap between an operative position and a non-operative position upon rotating said outer hollow shell relative to said inner hollow shell;

wherein said outer hollow shell comprises a cylindrical side wall with a spray passage and a finger passage extending therethrough;

wherein said pod member and said base ring member are connected to one another via a flexible hinge that allows said pod member to pivot relative to said base ring member upon application of an axial force to said top end of said pod member;

wherein said base ring member includes a cylindrical side wall having a domed upper portion, and wherein said flexible hinge extends between, and physically connects, said bottom end of said pod member and said domed upper portion.

2. The aerosol cap of claim 1, wherein said side wall includes oppositely disposed finger depressions to facilitate rotation of said outer hollow shell relative to said inner hollow shell.

3. The aerosol cap of claim 1, wherein said pod member comprises:

a closed top end;

an open bottom end; and a cylindrical side wall that includes a side spray aperture;

wherein said cam profile is located at said bottom end of said pod member.

4. The aerosol cap of claim 1, wherein said flexible hinge and said spray aperture are circumferentially aligned with one another.

5. The aerosol cap of claim 1, wherein said button support includes three radially spaced apart elongated ribs, each of said elongated ribs extending axially from said top end of said pod member, at least one of said elongated ribs including a fin for mating with a channel of the button actuator.

6. An aerosol cap adapted to mate with a two-piece canister, said aerosol cap comprising:

an outer hollow shell that includes at least one rib element; and an inner hollow shell that is partially enclosed by said outer shell and centrally disposed therein, said inner and outer shells being physically interconnected together by said at least one rib element, said inner hollow shell including a cam profile for cooperating with said at least one rib element to transition said aerosol cap between an operative position and a non-operative position upon rotating said outer hollow shell relative to said inner hollow shell;

wherein said outer hollow shell comprises a cylindrical side wall with a spray passage and a finger passage extending therethrough;

wherein said pod member comprises a closed top end, an open bottom end, and a cylindrical side wall that includes a side spray aperture;

wherein said cam profile is located at said bottom end of said pod member:, wherein said pod member and said base ring member are connected to one another via a flexible hinge that allows said pod member to pivot relative to said base ring member upon application of an axial force to said top end of said pod member;

wherein said base ring member includes a cylindrical side wall having a domed upper portion, and wherein said flexible hinge extends between, and physically connects, said bottom end of said pod member and said domed upper portion.

7. The aerosol cap of claim 6, wherein said side wall includes oppositely disposed finger depressions to facilitate rotation of said outer hollow shell relative to said inner hollow shell.

8. An aerosol cap comprising:

an outer hollow shell that includes at least one rib element; and an inner hollow shell that is partially enclosed by said outer shell and centrally disposed therein, said inner and outer shells being physically interconnected together by said at least one rib element, said inner hollow shell comprising a base ring member hingedly connected to a pod member, said pod member including a button support for receiving a button actuator of the canister, said pod member further including a cam profile for cooperating with said at least one rib element to transition said aerosol cap between an operative position and a non-operative position upon rotating said outer hollow shell relative to said inner hollow shell;

wherein said outer hollow shell comprises a cylindrical side wall with a spray passage and a finger passage extending therethrough;

wherein said pod member comprises a closed top end, an open bottom end, and a cylindrical side wall that includes a side spray aperture;

wherein said cam profile is located at said bottom end of said pod member;

wherein said base ring member includes a cylindrical side wall having a domed upper portion, said flexible hinge extending between, and connecting, said bottom end of said pod member and said domed upper portion;

wherein said outer hollow shell further comprises a plurality of reinforcement ribs extending radially between an inner surface of a cylindrical side wall and an outer surface of a cylindrical wall;

wherein an upper portion of said base ring member includes two circumferentially spaced apart stop detents that are configured to cooperate with said plurality of reinforcement ribs to securely maintain said aerosol cap in the operative and non-operative positions;

wherein said outer hollow shell partially encloses, and is concentric with, said pod member in both the operative and non-operative positions.

* * * * *